US005425252A

United States Patent [19]

Lonati

[11] Patent Number: 5,425,252

[45] Date of Patent: Jun. 20, 1995

[54] NEEDLE SELECTION DEVICE FOR CIRCULAR KNITTING MACHINES FOR MANUFACTURING SOCKS, STOCKINGS OR THE LIKE

[75] Inventor: Ettore Lonati, Brescia, Italy

[73] Assignee: S.F.I.M. S.r.l., Brescia, Italy

[21] Appl. No.: 274,890

[22] Filed: Jul. 14, 1994

[30] Foreign Application Priority Data

Jul. 29, 1993 [IT] Italy ..... MI93A1711

[51] Int. Cl.[6] ..... D04B 15/78

[52] U.S. Cl. ..... 66/219; 66/218; 66/222

[58] Field of Search ..... 66/215, 216, 217, 218, 66/219, 220, 221, 222

[56] References Cited

U.S. PATENT DOCUMENTS

| | | | |
|---|---|---|---|
| 3,955,380 | 5/1976 | Piccino et al. | 66/222 X |
| 3,990,270 | 11/1976 | Paepke | 66/222 X |
| 4,770,009 | 9/1988 | Mozer | 66/218 |

FOREIGN PATENT DOCUMENTS

| | | | |
|---|---|---|---|
| 2424190 | 12/1975 | Germany | 66/219 |
| 1257491 | 12/1971 | United Kingdom | 66/219 |
| 1354980 | 5/1974 | United Kingdom | 66/219 |
| 2112822 | 7/1983 | United Kingdom | 66/219 |

*Primary Examiner*—John J. Colvert
*Attorney, Agent, or Firm*—Guido Modiano; Albert Josif

[57] ABSTRACT

The needle selection device has multiple selectors arranged in axial grooves formed in the skirt of the needle cylinder, each selector arranged below a needle and oscillatable in a radial plane of the needle cylinder from an active position, in which a butt protrudes radially from its groove, for the engagement of the butt with cams for actuating the selectors arranged around the needle cylinder to move the selectors along their groove in the needle cylinder so as to activate the overlying needle, to an inactive position, in which the selector is positioned in its groove in the needle cylinder so that it does not interfere with the selector actuation cams. The device has selector extraction elements to transfer the selectors from the inactive position to the active position and selection elements to transfer the selectors from the active position to the inactive position or to keep them in the active position. Each selector is provided with a selection element protruding radially from the grooves of the needle cylinder and oscillatable in the plane of arrangement of its selector. The selection element is made of a material that can be magnetized, and an electromagnet is provided for magnetizing the selection element and magnetic elements interact with the selection element after magnetization to make it oscillate into an idle position, in which the selection element engages a selector sinker cam laterally facing the needle cylinder, or into an active position, in which the selection element does not interfere with the sinker cam.

14 Claims, 4 Drawing Sheets

NEEDLE SELECTION DEVICE FOR CIRCULAR KNITTING MACHINES FOR MANUFACTURING SOCKS, STOCKINGS OR THE LIKE

BACKGROUND OF THE INVENTION

The present invention relates to a needle selection device for circular knitting machines for manufacturing socks, stockings or the like.

As is known, in knitting machines for manufacturing socks, stockings or the like there are needle selection devices which, by selecting the needles to be moved to knit at a feed of the machine, allow to produce particular patterns or designs.

In some types of circular machine said selection devices comprise multiple selectors individually arranged in one of the grooves formed in the skirt of the needle cylinder below the related needle. Said selectors can individually oscillate in the radial plane of the needle cylinder in which they are arranged from an active position, in which they protrude radially with a butt from the related groove of the needle cylinder so as to engage, by means of said butt, a selector actuation cam that moves them along their groove so as to move the overlying needle to knit, to an inactive position in which the selector is fully sunk with its butt inside its groove so that it does not engage the selector actuation cams, keeping the overlying needle in idle position, i.e. in a position in which the needle does not pick up the thread at the following feed of the machine. The oscillation of the selectors from the inactive position to the active position is performed by means of extraction cams which can be of the fixed type, i.e. fixed to the support of the needle cylinder, or of the movable type so that they can be activated or deactivated by command. Downstream of the extraction cams, along the direction of the rotation of the needle cylinder about its axis with respect to said cams, there are actuation means which perform the actual selection of the selectors according to the type of design or pattern to be produced. Some of these selection means are simply constituted by levers which laterally face the needle cylinder and are arranged at a level corresponding to the position of secondary butts of the selector. Said levers can be actuated so as to interfere with said secondary butts in order to move the selector into its inactive position, avoiding its subsequent engagement with the actuation cam, or can be moved into such a position as to not interfere with the secondary butts of the selector in order to keep the related selector in the extraction position produced by the preceding action of the extraction cams.

In some types of selection device said levers are actuated by means of electromagnetic actuators, by means of piezoelectric actuators in other types of device, and by means of pneumatic-type actuators in further types of device.

Selection devices have recently been proposed that use the different behavior of an element which acts directly or indirectly on the selector according to the magnetization to which it has been subjected. This intermediate element is magnetized by means of electromagnets which can perform a different magnetization in an extremely short time and can thus ensure diversification in selection from one needle to the next even at high needle cylinder rotation speeds.

Despite being able to achieve good precision in needle selection even at the high operating speeds of knitting machines for manufacturing socks and stockings, the selection devices proposed so far, that use the magnetization of an intermediate element acting directly or indirectly on the associated selector, have the drawback that their application requires substantial structural modifications of currently commercially available machines. Accordingly, the use of devices of this type has so far been extremely limited.

Furthermore, in many cases the application of said devices would increase the difficulty of maintenance actions performed on the machine after its assembly.

SUMMARY OF THE INVENTION

A principal aim of the present invention is to solve the above described problems by providing a needle selection device for circular knitting machines for manufacturing socks, stockings or the like, which can ensure high selection precision even at high machine operating speeds without requiring excessive modifications of the structure of currently commercially available machines.

Within the scope of this aim, an object of the invention is to provide a selection device that allows to reduce the mass of the selector and therefore its inertia, making selection more reliable.

Another object of the invention is to provide a device that has a limited space occupation around the needle cylinder so as to allow interventions on the machine after its assembly to be extremely easily performed.

Another object of the invention is to provide a selection device that also allows to reduce the mass of the needle cylinder, with significant advantages in terms of construction costs and in terms of the maximum actuation speed of the needle cylinder.

With the foregoing and other-objects in view, the invention provides a needle selection device for circular knitting machines for manufacturing socks, stockings or the like, which comprises multiple selectors arranged in the axial grooves formed in the skirt of the needle cylinder, each one of said selectors being arranged below a needle and oscillatable in a radial plane of the needle cylinder from an active position, in which it protrudes radially from its groove with a butt, for the engagement of said butt with cams for actuating the selectors arranged around the needle cylinder to move said selectors along their groove in the needle cylinder so as to activate the overlying needle, to an inactive position, in which said selector is sunk in its groove in the needle cylinder so that it does not interfere with said selector actuation cams, selector extraction means being provided to transfer said selectors from said inactive position to said active position, selection means being also provided to transfer said selectors from said active position to said inactive position or to keep them in said active position, characterized in that each one of said selectors is provided with a selection element that protrudes radially from the grooves of the needle cylinder and is oscillatable in the plane of arrangement of its selector, said selection element being made of a magnetizable material, means being provided for magnetizing said selection element, magnetic means being also provided which interact with said selection element after its magnetization to make it oscillate into an idle position, in which said selection element engages a selector sinker cam which laterally faces the needle cylinder for the transfer of its selector into said inactive position, or into an active position, wherein said selection element does not interfere with said sinker cam to keep its selector in said active position.

BRIEF DESCRIPTION OF THE DRAWINGS

Further characteristics and advantages of the device according to the invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 2:
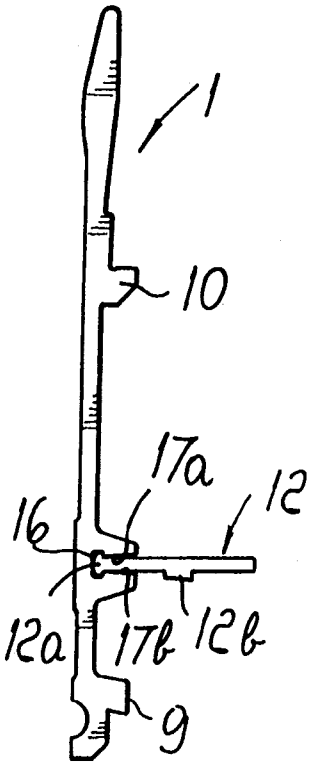
FIG. 2 is a lateral elevation view of a selector with its selection element.
Figure 1:
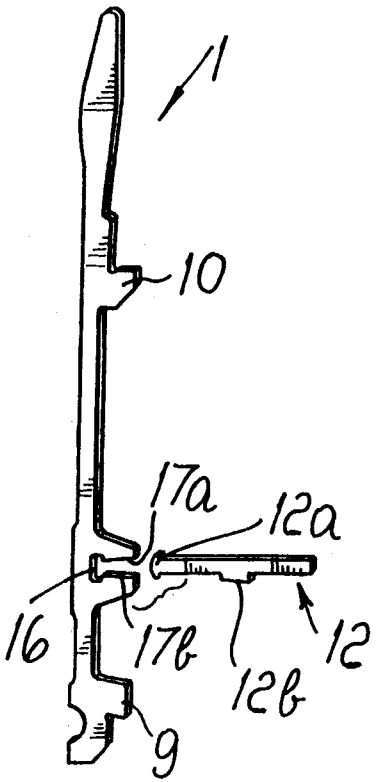
FIG. 1 is an exploded perspective view of a selector with its selection element.
Figure 3:
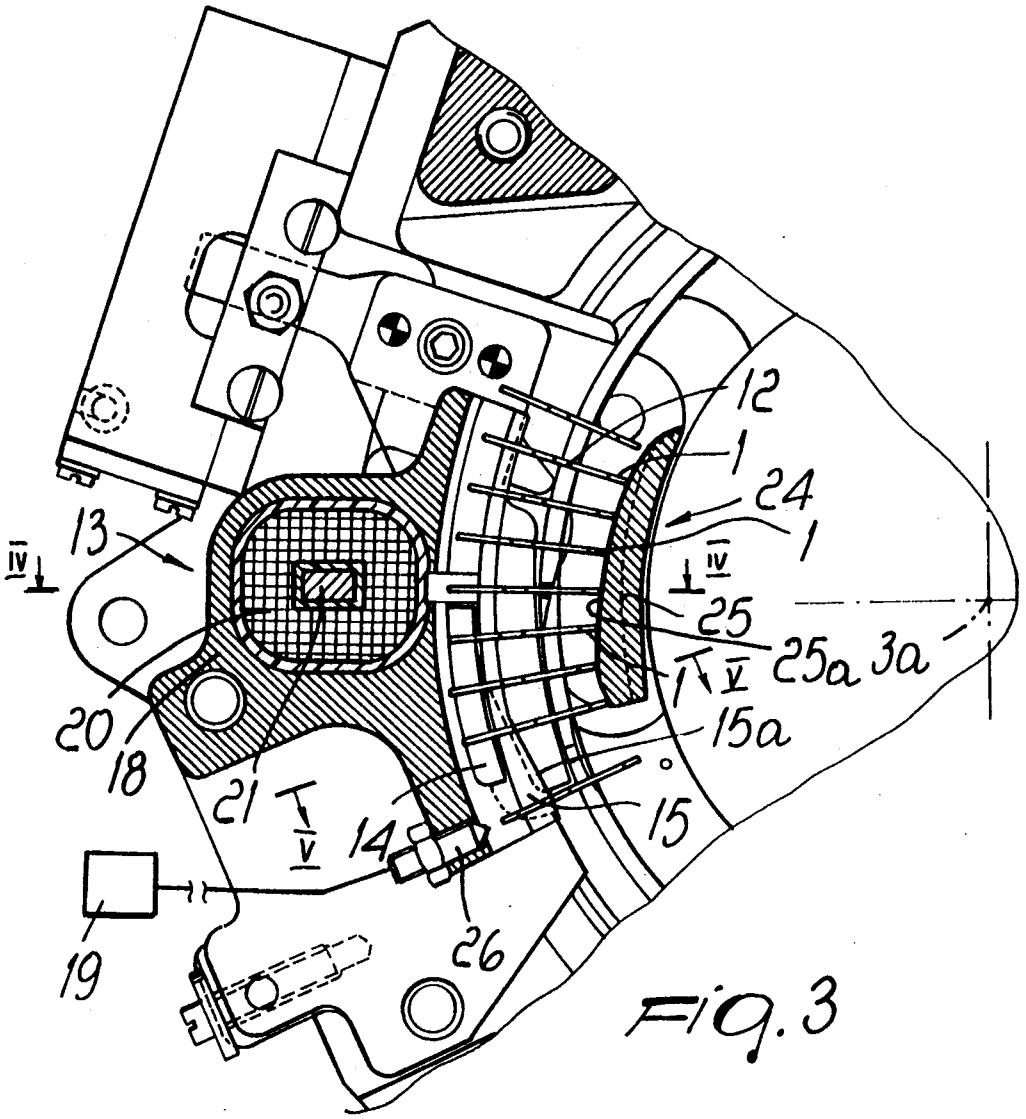
FIG. 3 is a schematic top plan view of a portion of a circular knitting machine for manufacturing socks and stockings, provided with the device according to the invention, in which the needle cylinder has been omitted.
Figure 4:
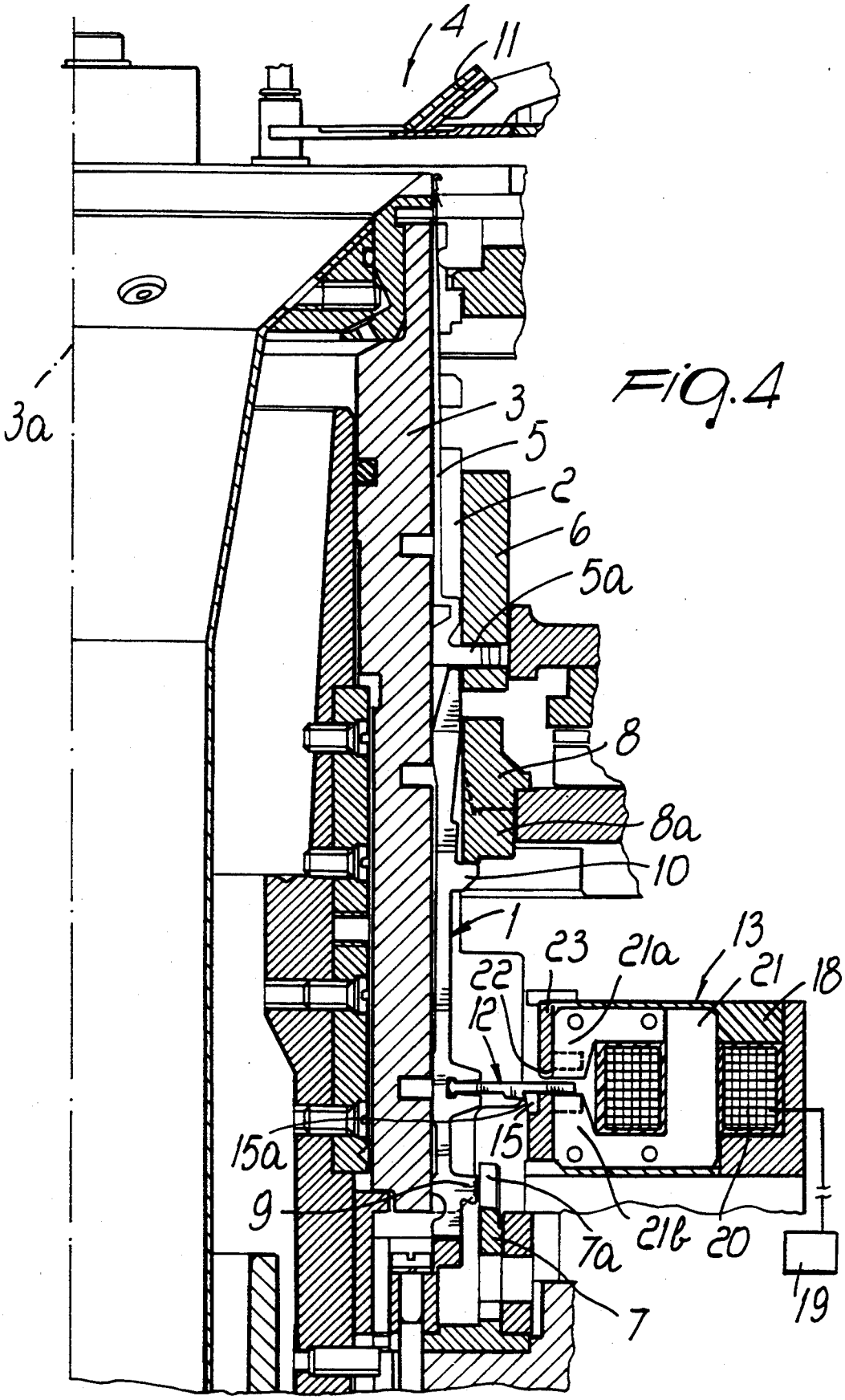
FIG. 4 is a schematic sectional view of a circular knitting machine for manufacturing socks and stockings, taken along the plane IV—IV, which shows the operation of the magnetization means of the device according to the invention.

With reference to the above figures, the selection device according to the invention comprises multiple selectors 1 which are slideably accommodated inside grooves 2 formed in the skirt of the needle cylinder 3 of a circular knitting machine for manufacturing socks, stockings or the like, generally designated by the reference numeral 4. Each selector 1 is arranged in its own groove below a needle 5, and the needle cylinder 3 can be rotated about its own axis 3*a* with respect to needle actuation cams 6 and with respect to selector actuation cams, respectively designated by the reference numerals 7 and 8, which laterally face the needle cylinder 3.

The needle actuation cams 6 form paths for the butts 5*a* of the needles, and the selector actuation cams 7 and 8 likewise form paths for the butts 9 and 10 of the selectors so as to cause the upward or downward sliding of the needles to cause them to engage the thread at the various feeds of the machine, whereat thread guides 11 feed the thread to the needles.

Each selector 1 can oscillate within its groove 2, in a plane which is radial with respect to the needle cylinder 3, from an active position, in which it protrudes radially from said groove 2 with the butt 9 so as to engage, with said butt 9, the selector actuation cam 7, to an inactive position in which it is fully sunk, with the butt 9, inside its groove so that it does not engage the selector actuation cam 7.

The selector actuation cam 7 is arranged proximate to the lower end of the needle cylinder 3 and is shaped like a ring that laterally surrounds the needle cylinder 3 with rising portions 7*a* to lift the selectors 1 when the butt 9 engages said actuation cam 7. The selector actuation cam 7 also has descending portions, not shown for the sake of simplicity, with which the butt 9 of the selectors engages when it is lowered by the action of the actuation cam 8 which has descending portions 8*a* with which the butt 10 of the selector engages.

According to the invention, each selector has a selection element 12 that protrudes radially from its groove 2 in the needle cylinder 3 and can oscillate in the plane of arrangement of the related selector 1. Said selection element 12 is made of a material that can be magnetized, and there are means 13 for magnetizing the selection element 12 and magnetic means 14 that interact with the selection element 12 after its magnetization to cause it to oscillate into an idle position, in which the selection element 12 engages a selector sinker cam 15 which laterally faces the needle cylinder 3, or into an active position, in which the selection element 12 does not interfere with the sinker cam 15 to keep its selector 1 in the active position.

More particularly, the selection element 12 is substantially shaped like a lamina, with a thickness substantially equal to the thickness of the related selector 1, with an enlarged end 12*a* that is accommodated inside a seat 16 formed in an intermediate region of the extension of the selector 1. Said seat 16 has, on its side directed towards the outside of the needle cylinder, i.e. the same side of the selector from which the butts 9 and 10 protrude, an opening in order to allow the remaining part of the selection element 12 to protrude. Said opening forms two oppositely arranged shoulders 17*a* and 17*b* that delimit the oscillation arc of the selection element 12.

In practice, the body of the selector 1 of the device according to the invention is elongated and shaped like a lamina with a lower butt 9 and with an upper butt 10 which protrude laterally from the body of the selector, and is thus extremely simplified with respect to conventional selectors. Furthermore, the length and overall weight of the selector 1 are significantly reduced with respect to the weight and length of the selectors with multiple secondary butts used to perform their selection which are currently used in known machine types.

The selection element 12 has a butt 12*b* on its side which is directed towards the base of the needle cylinder 3 when the related selector 1 is mounted on the machine 9; said butt protrudes from the remaining part of the body of the selection element 12 and can engage the sinker cam 15.

The magnetization means 13 are constituted by an electromagnet 18 which laterally faces the needle cylinder at the level of the selection elements 12 and can be actuated by command by means of a control unit 19, for example an electronic programmable controller, which supervises the operation of the machine.

Conveniently, the electromagnet 18 comprises a coil 20, which is connected in a per se known manner to a direct-current power supply, and a core 21 passing through said coil 20 and extending towards the needle cylinder with its poles 21*a* and 21*b*. The poles 21*a* and 21*b* are mutually facing and spaced so as to allow the end of the selection elements 12 which is opposite to the end provided with the enlarged portion 12*a* to pass through said poles 21*a* and 21*b*.

Advantageously, upstream of the electromagnet 18 along the direction of the rotation of the needle cylinder 3 with respect to the needle and selector actuation cams, as well as upstream of said electromagnet, there are means for guiding the selection elements 12 so as to convey them through the poles 21*a* and 21*b*. Said guiding means are preferably constituted by a track 22 formed inside a plate 23 which laterally faces the needle cylinder. The inlet of said track 22 is conveniently flared so as to receive, during the rotation of the needle cylinder, even the selection elements 12 which are not perfectly aligned with the passage formed between the poles 21*a* and 21*b*, and gradually tapers so as to move the selection elements 12 into the correct position.

The magnetic means 14 are simply constituted by a permanent magnet or by two permanent magnets which face the selection elements 12 downwardly and upwardly and are mounted on a support arranged laterally with respect to the needle cylinder between the electromagnet 18 and the sinker cam 15.

The permanent magnet or magnets are arranged so as to produce a magnetic field that causes the selection elements 12 to oscillate in an upward direction or in a downward direction according to the magnetization applied to said selection elements 12 by the electromagnet 18.

The sinker cam 15 can be mounted on the same support as the magnetic means 14, and has a profile 15*a* which gradually approaches the needle cylinder 3 along the direction of the rotation of the needle cylinder with respect to the needle and selector actuation cams.

Upstream of the magnetization means 13 along the direction of the rotation of the needle cylinder there are selector extraction means 24 which can be constituted, in a per se known manner, by extraction cams fixed to the supporting structure of the machine proximate to the lower end of the needle cylinder. Said extraction cams have a profile that gradually moves away from the axis 3*a* of the needle cylinder along the direction of the rotation of the needle cylinder. As an alternative, the extraction means 24 can also be constituted by moving cams 25 which have a profile 25*a* that gradually moves away from the needle cylinder axis, like the profile of the fixed-type extraction cams, and can be moved radially towards or away from the axis 3*a* of the needle cylinder 3 so as to engage or not engage the side of the selectors directed towards the needle cylinder axis according to the requirements.

In practice, the arrangement of the various elements that form the selection device according to the invention is as follows: upstream of each feed of the machine along the direction of the rotation of the needle cylinder there is an extraction cam 25; the electromagnet 18 is arranged at said extraction cam; downstream of said electromagnet there is the permanent magnet or magnets 14; and downstream of said permanent magnet 14 there is the sinker cam 15. It should be noted that the extraction cam 25 can complete the extraction of the selector even after the position occupied by the electromagnet 18. Finally, the rising portion 7*a* of the selector actuation cam 7 begins after the sinker cam 15.

Advantageously, downstream of the magnetic means 14 along the direction of the rotation of the needle cylinder with respect to the needle and selector actuation cams, there is a sensor element 26 which laterally faces the needle cylinder and is arranged at the level of the selection elements 12. Said sensor element 26, which can be constituted by a conventional proximity sensor, is connected to the control unit 19 and is made so as to supply it with a different signal depending on the passage of a selection element 12 in idle position or of a selection element 12 in active position in order to allow the unit 19 to check the selection that has actually been performed and interrupt the actuation of the machine if said actual selection does not match the one that had been set.

The operation of the needle selection device according to the invention is as follows.

Figure 5:
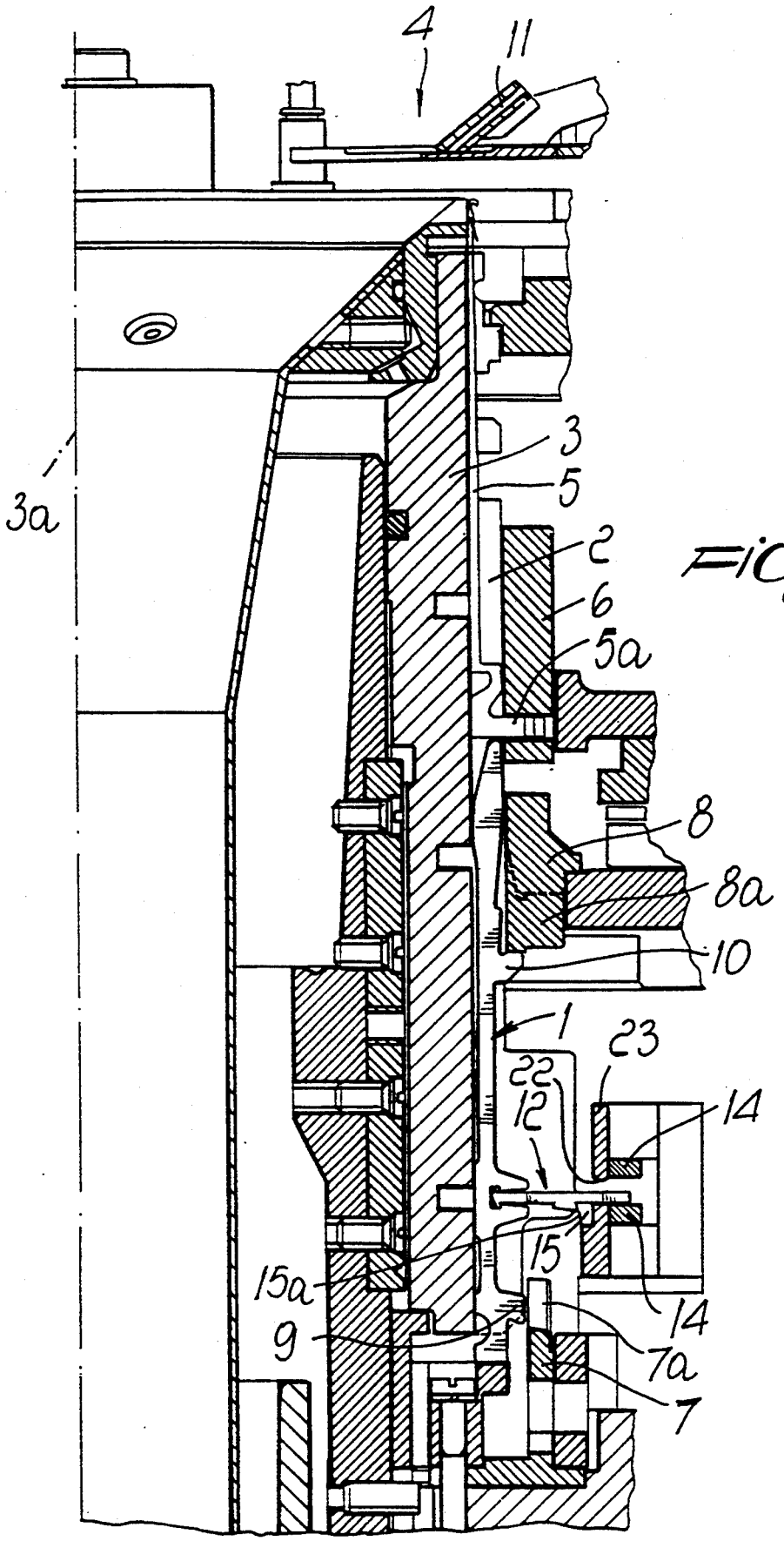
FIG. 5 is a schematic sectional view of a circular knitting machine for manufacturing socks and stockings, taken along the axis V—V, which shows an operating condition of the device according to the invention.

If a given needle 5 is not to be raised to engage the thread at a feed of the machine, when the selection element 12 of its selector 1 passes through the poles 21*a* and 21*b*of the electromagnet 18, said electromagnet 18 is activated so as to magnetize the selection element 12 with a polarization that causes the selection element 12 to oscillate in a downward direction when it passes the permanent magnet 14. Meanwhile the selector 1 is affected by the action of the extraction cam 25 and the butt 9 is caused to protrude radially from the needle cylinder 3. The downward oscillation of the selection element 12 causes the butt 12*b* thereof to engage the sinker cam 15 which causes the selector 1 to return into the inactive position and thus prevents the engagement of the butt 9 with the actuation cam 7. Due to this fact the selector 1 is not raised and therefore its overlying needle 5 is not moved to knit at the feed being considered (FIG. 5).

Figure 6:
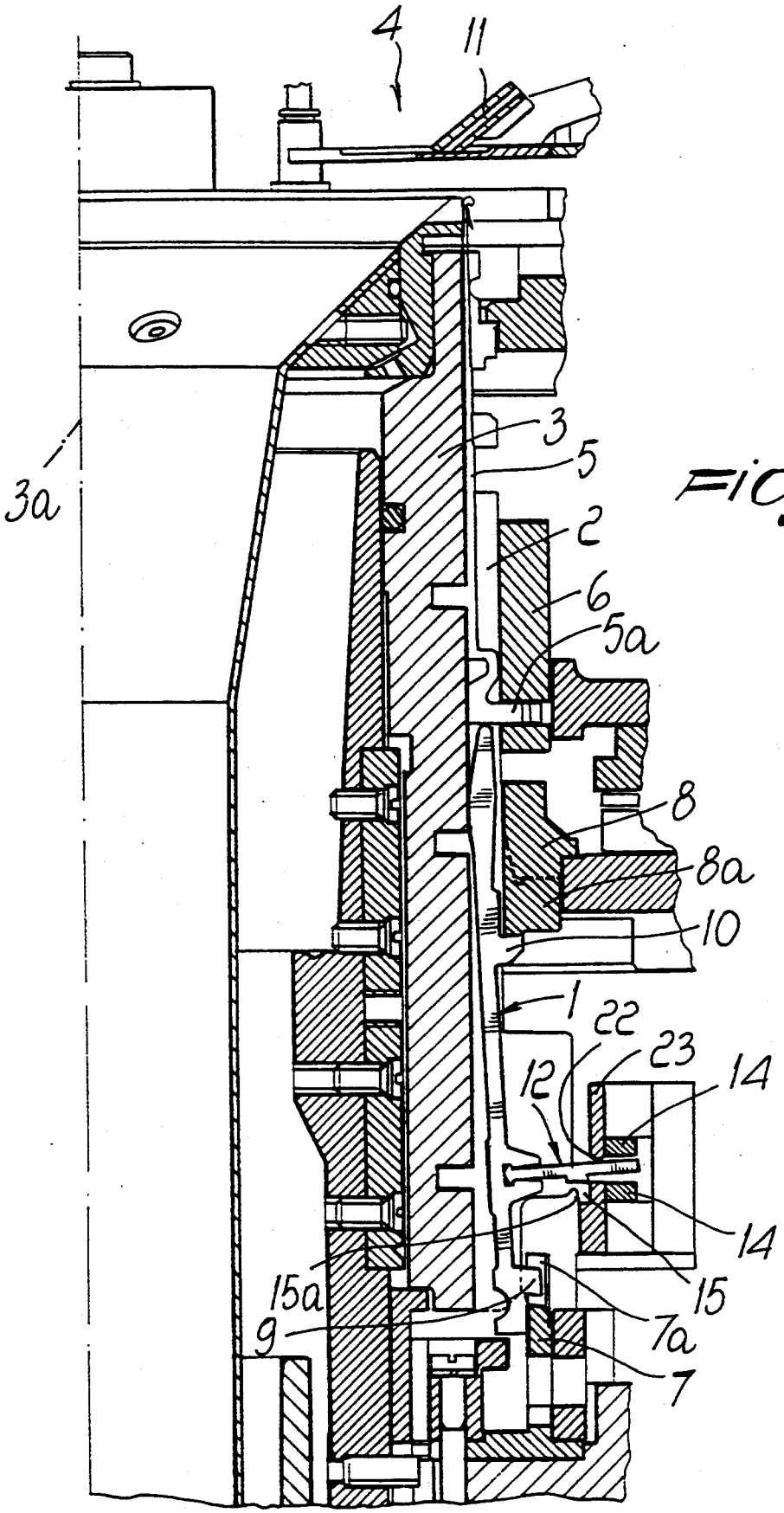
FIG. 6 is a schematic sectional view, taken similarly to FIG. 5, which shows another operating condition of the device according to the invention.

If instead a needle 5 is to be moved to knit at said feed, it is sufficient to magnetize the selection element 12 in the opposite manner when it passes between the poles 21*a* and 21*b* of the electromagnet 18. In order to achieve magnetization with the opposite polarity it is sufficient to reverse the polarity of the power supply of the coil 20. With such magnetization, the selection element 12 oscillates upwards and therefore the butt 12*b* does not engage the sinker cam 15, and its selector 1, after extraction thereof has been performed by the extraction cam 25, is kept in the active position and its butt 9 engages the rising portion 7*a* of the actuation cam 7, consequently lifting the needle 5, which is moved so as to engage the thread at the feed being considered (FIG. 6).

In practice it has been observed that the selection device according to the invention fully achieves the intended aim and objects, it allows in fact to achieve an extremely precise selection since it is possible to vary the magnetization of the various selection elements in a very short time that allows actual needle-by-needle selection without requiring excessive structural modifications of currently commercially available knitting machines for manufacturing socks, stockings or the like.

An additional advantage resides in the fact that by using shorter selectors it is possible to reduce the height of the needle cylinder and thus reduce the overall inertia of the rotating parts of the machine, allowing to reach even higher actuation speeds than possible with currently commercially available machines.

The reduction in the mass of the selector of the device according to the invention furthermore allows to achieve higher precision and speed in the actuation of the selector, obtaining higher reliability in selection.

The device thus conceived is susceptible to numerous modifications and variations, all of which are within the scope of the inventive concept; all the details may furthermore be replaced with other technically equivalent elements.

In practice, the materials employed, so long as they are compatible with the specific use, as well as the dimensions, may be any according to the requirements and the state of the art.

What is claimed is:

1. Needle selection device for circular knitting machines having needle cylinders for manufacturing hosiery comprising multiple selectors arranged in axial grooves formed in a skirt of the needle cylinder, each one of said multiple selectors arranged below a needle having a butt and being oscillatable in a radial plane of the needle cylinder from an active position, wherein the needle butt protrudes radially from the cylinder groove, for the engagement of said butt with cams for actuating the selectors arranged around the needle cylinder and for moving said selectors along the groove in the needle cylinder so as to activate the overlying needle, to an inactive position, wherein said selector is withdrawn into the groove so that engagement with said selector actuation cams is eliminated, selector extraction means are provided radially inward of said needles for transferring said selectors from said inactive position to said active position, selection means for transferring said selectors from said active position to said inactive position or for retaining the selectors in said active position, wherein each one of said selectors is provided with a selection element which protrudes radially from the grooves of the needle cylinder and oscillates in the plane of arrangement of an associated selector, said selection element being made of a magnetizable material, means being provided for magnetizing said selection element, magnetic means being also provided which interact with said selection element after magnetization to cause oscillation into an idle position, in which said selection element engages a selector sinker cam, laterally facing the needle cylinder, for transferring the selector into said inactive position, or into an active position, in which said selection element bypasses the sinker cam so as to keep the selector in said active position.

2. Device according to claim 1, wherein each of said selection elements has one end accommodated in a seat formed in an intermediate region of the body of one of said selectors, said seat having an opening on a side of said selector which is directed radially outwardly of the needle cylinder for the protrusion of said selection element.

3. Device according to claim 2, wherein said opening forms two oppositely arranged shoulders which delimit an arc along which said selection element oscillates.

4. Device according to claim 1, wherein the selection element has a body in the shape of a lamina with an enlarged portion at the end accommodated in said seat.

5. Device according to claim 1, wherein said selection element has, on a side directed towards the base of the needle cylinder, a butt for engagement with said sinker cam when in the idle position, said cam having a profile gradually approaching the needle cylinder in a direction of rotation of the needle cylinder.

6. Device according to claim 1, wherein said magnetization means further comprise an electromagnet actuated by command and which laterally faces the needle cylinder at a level of said selection elements.

7. Device according to claim 6, wherein said electromagnet has two mutually facing poles separated by a passage for accommodation of the end of each of said selection elements.

8. Device according to claim 7, wherein upstream of said electromagnet, along a direction of rotation of the needle cylinder, are means for guiding said selection elements towards said passage between the poles of said electromagnet.

9. Device according to claim 1, wherein said magnetic means further comprises at least one permanent magnet which is arranged between said magnetization means and said sinker cam for producing a magnetic field for the oscillation, in one direction or another, of said selection elements according to the magnetization produced by said magnetization means.

10. Device according to claim 6, comprising an element for sensing a position of each of said selection elements, said sensor element being arranged downstream of said magnetization means along a direction of rotation of the needle cylinder, and being connected to a control unit of the machine for controlling the activation of said magnetization means.

11. Selector for circular knitting machines for manufacturing hosiery, said selector comprising an elongated body in the shape of a lamina with at least one butt protruding laterally from one side thereof, wherein the selector has a selection element oscillatably coupled to the body of the selector in a plane of arrangement of said body, said selection element being made of a magnetizable material and said selection element protrudes laterally from the body of the selector on the same side as said butt.

12. Selector according to claim 11, wherein said selection element has an end accommodated in a seat formed in an intermediate region of the body of said selector, said seat having an opening on the same side of said selector as said butt.

13. Selector according to claim 12, wherein said selection element has a lamina shaped body having an enlarged portion at the end accommodated in said seat.

14. Selector according to claim 12, wherein said opening forms two oppositely arranged shoulders delimiting an arc of oscillation of said selection element.

* * * * *